US006170303B1

(12) United States Patent
Hong et al.

(10) Patent No.: US 6,170,303 B1
(45) Date of Patent: Jan. 9, 2001

(54) WASHING MACHINE EQUIPPED WITH AN AIR BUBBLE GENERATOR HAVING CONTRACTION/ENLARGEMENT EXHAUST NOZZLES

(75) Inventors: Dae-Yeong Hong, Incheon; Moo-Saeng Lim, Seoul, both of (KR)

(73) Assignee: Daewoo Electronics Co., Ltd., Seoul (KR)

( * ) Notice: Under 35 U.S.C. 154(b), the term of this patent shall be extended for 0 days.

(21) Appl. No.: 09/188,210

(22) Filed: Nov. 9, 1998

(51) Int. Cl.[7] ..... D06F 39/02

(52) U.S. Cl. ..... 68/183; 68/207; 134/102.2

(58) Field of Search ..... 134/102.1, 102.2; 68/207, 183; 366/176.1, 340; 261/113, 100, 77, 123, 123.1

(56) References Cited

U.S. PATENT DOCUMENTS

| | | | | |
|---|---|---|---|---|
| 920,171 | * | 5/1909 | Parker | 68/183 |
| 2,025,800 | * | 12/1935 | Burslem | 68/183 |
| 2,241,337 | * | 5/1941 | Work | 134/102.2 |
| 2,750,950 | * | 6/1956 | Inman et al. | 134/102.1 |
| 4,727,896 | * | 3/1988 | Kanazawa et al. | 134/102.1 |
| 5,253,380 | | 10/1993 | Lim et al. . | |
| 5,295,373 | | 3/1994 | Lim et al. . | |
| 5,307,649 | | 5/1994 | Lim et al. . | |

FOREIGN PATENT DOCUMENTS

| | | | | |
|---|---|---|---|---|
| 2907562 | * | 8/1980 | (DE) | 68/183 |
| 0 495 168 | | 7/1992 | (EP) . | |
| 0 735 178 | | 10/1996 | (EP) . | |
| 1120249 | * | 4/1956 | (FR) | 68/183 |
| 6486 | * | of 1909 | (GB) | 68/183 |
| 458451 | * | 12/1936 | (GB) | 134/102.2 |
| 13226 | * | 7/2000 | (GB) | 68/183 |
| 60-55996 | * | 4/1985 | (JP) | 68/183 |
| 2-149293 | * | 6/1990 | (JP) | 68/183 |

* cited by examiner

*Primary Examiner*—Frankie L. Stinson
(74) *Attorney, Agent, or Firm*—Smith, Gambrell & Russell, LLP

(57) ABSTRACT

Outlets of a contraction/enlargement exhaust nozzle type are formed in an air bubble-generating plate from which fine air bubbles are generated. The outlets are constituted with outer outlets and inner outlets. The outer outlets are formed along edge portions of the air bubble-generating plate and the inner outlets are formed in the inner portions of the air bubble-generating plate. Each of the outlets has a flow-in portion, a contraction portion, and a flow-out portion which are aligned in a coaxial line and have different diameters, so that each of the outlets are formed in a shape of a contraction/enlargement exhaust nozzle type. A diameter of the flow-out portion is smaller than a diameter of the flow-in portion, but larger than a diameter of the contraction portion. A height of the contraction portion is larger than a height of the flow-out portion, but smaller than a height of the flow-in portion. The diameters of contraction portions of the outer outlets are smaller than those of contraction portions of the inner outlets. Fine air bubbles are generated from an air bubble generator having outlets of a contraction/enlargement exhaust nozzle type.

4 Claims, 5 Drawing Sheets

WASHING MACHINE EQUIPPED WITH AN AIR BUBBLE GENERATOR HAVING CONTRACTION/ENLARGEMENT EXHAUST NOZZLES

BACKGROUND OF THE INVENTION

1. Field of the Invention

The present invention relates to a washing machine, more particularly to a washing machine equipped with an air bubble generator having contraction/enlargement exhaust nozzles for providing fine air bubbles of a very small diameter.

2. Description of the Prior Art

In general, washing machines are classified into two categories. The first one of the two categories includes a whirl-type washing machine in which washing articles are washed by a vortex flow of washing water formed in a washer tub when a pulsator is rotated. The second one includes a drum-type washing machine. The drum-type washing machine has a rotary drum a portion of which lies in the washing water. In such a rotary drum, the washing articles are put in the rotary drum. When the rotary drum is rotated, the washing articles in the rotary drum strike each other, so that the washing articles are washed.

In order to enhance washing efficiency of the drum-type washing machine, an air bubble generator for the drum-type washing machine is proposed. FIG. 1 is a schematic view of a conventional drum-type washing machine with an air bubble generator, FIG. 2 is an enlarged perspective view of the rotary drum of FIG. 1, and FIG. 3 is an enlarged perspective view of the air bubble generator of FIG. 1.

Hereinafter, the conventional drum-type washing machine with an air bubble generator will be described with reference to accompanying drawings.

In the vortex-flow type washing machine as shown in FIG. 1, the washer tub 20 is mounted to be rotated in the reservoir 10. An air bubble generator 30 is mounted on the bottom of the reservoir 10. Air is supplied through an inlet 35 by an air pump(not shown). A pulsator 23 for generating the vortex flow is mounted to be rotated on the washer tub 20. An air bubble passageway 25 is formed in the bottom of the washer tub 20. An outlet 15 is formed in the bottom of the reservoir, that is, under the air bubble generator 30.

The drum type washing machine as shown in FIG. 2 has a housing 40 and a reservoir 50 mounted in the housing 40 for accommodating washing water. A rotary drum (hereinafter, called ?a drum?) 60 has a plurality of through-holes 64 for washing water to flow in and out of the drum 60. The drum 60 includes traverse slits 68 for washing water to flow in the drum 60, and the traverse slits 68 are formed in the surface of the drum 60 in parallel with the shaft(not shown) of the drum 60. A part of the drum 60 lies in the washing water. An air bubble generator 70 is mounted on the bottom of the reservoir 50. The air bubble generator 70 is supplied with compressed air through a conduit 75.

FIG. 3 shows an air bubble generator capable of being applied to the washing machines of FIGS. 1 and 2.

The air bubble generator includes an inlet 84 adapted to be connected with an air pump (not shown) and a case 80 in which water flow-out portions 88 are formed in a slantedly opposite manner and opposite to the inlet 84. A porous member 85 is mounted in the case 80 between the inlet 84 and the water flow-out portions 88. Air flowing in through the air pump moves into the washing water through the porous member 85. The air flowing out of the porous member 85 is converted into fine air bubbles. An air bubble-generating plate(hereinafter, called ?a plate?) 90 having a plurality of outlets 94 is closely contacted with the water flow-out portions 88. An elastic plate 98 is further provided, one end of which is fixed on an upper end of the plate 90 so that air bubbles from the plate 90 are prevented from moving further up. As the air bubble generator is operated, the other end of the elastic plate 98, which is movable, is opened by air bubbles flowing out of the outlets 94. Each of the outlets 94 is in a cylindrical shape with a uniform diameter from the bottom to the top thereof.

Operations of the conventional air bubble generator as mention above will be described hereinafter.

As the air bubble generator is operated, compressed air flowing in through the inlet 84 is converted into fine air bubbles by the porous member 85, as shown in FIGS. 1 and 2. The fine air bubbles are dispersed into washing water through the outlets 94. The dispersed air bubbles serve to wash washing articles such as clothing by moving into the reservoir 20 or 50.

However, in the air bubble generator, some air bubbles may block the outlets 94 or may break since air bubbles may have a larger diameter than the outlets have. Accordingly, less air bubbles may be produced from the plate, so that less air bubbles flow into the reservoir and washing efficiency is deteriorated. Further, air bubbles move nearer to the washing water surface by buoyancy of the washing water. At this time, the water pressure with respect to the air bubbles becomes less, so that the size of an air bubble becomes larger enough to distort the shape of the air bubble. Accordingly, the washing efficiency can be obtained by fully generating fine air bubbles.

SUMMARY OF THE INVENTION

In order to solve the drawbacks to the conventional air bubble generator, it is the first object of the present invention to provide a washing machine equipped with an air bubble generator in which outlets are formed to fully generate air bubbles in a fine diameter.

It is the second object of the present invention to provide a washing machine equipped with an air bubble generator enabling more air bubbles to flow in the reservoir.

It is the third object of the present invention to provide a washing machine equipped with an air bubble generator capable of enhancing washing efficiency.

In order to achieve the above objects, the following considerations should be taken.

Firstly, each of the outlets has a small diameter for providing air bubbles of a fine diameter into washing water in the reservoir. However, although a small diameter of an outlet is theoretically preferable, a much smaller diameter with respect to the height of the air bubble generator prevents air from flowing out of the outlet since a water membrane is formed in the outlet.

Secondly, more air bubbles must flow into the washing water in the reservoir in order to enhance washing efficiency. To do so, air bubbles of a small diameter are preferable at an early stage when air bubbles flow in the reservoir. As air flows out of a porous member in the washing water, a flowing-out rate of the air influences on a size of an air bubble. That is, when the flowing-out rate is high, the diameter of an air bubble may become larger before an air bubble rises up, since air is continuously supplied or since air bubbles are incorporated together. However, when the flowing-out rate is low, air bubbles are intermittently generated, so that a diameter of each of the air bubbles may become smaller. Such flowing-out rate can be controlled by varying a ratio between flowing-out and flowing-in areas.

A washing machine equipped with an air bubble generator comprises an air bubble-generating plate in which outlets of a contraction/enlargement exhaust nozzle type are formed.

The outlets are constituted with outer outlets and inner outlets. The outer outlets are formed along edge portions of the air bubble-generating plate, and the inner outlets are formed in the inner portions of the air bubble-generating plate. A diameter of each of the outer outlets is smaller than a diameter of each of the inner outlets. Each of the outlets has a cylindrical shape and includes a flow-in portion for receiving the compressed air, a contraction portion communicating with the flow-in portion and for contracting the received air, and an enlargement portion communicating with the contraction portion and for enlarging the contracted air. The flow-in portion, the contraction portion, and the flow-out portion are aligned in a coaxial line. A diameter of the flow-out portion is smaller than a diameter of the flow-in portion, but larger than a diameter of the contraction portion. A height of the contraction portion is larger than a height of the flow-out portion, but smaller than a height of the flow-in portion.

The following effects may be obtained by a washing machine equipped with an air bubble generator according to the embodiment of the present invention.

Firstly, dynamic resistance and flow-out pressure with respect to air bubbles become low since outlets are formed in a contraction/enlargement exhaust nozzle type.

Secondly, a water membrane in an outlet is prevented so that air bubbles flow out of the outlet well since the height of the contraction portion of a small diameter is very small compared to the width of the air bubble generator.

Thirdly, fine air bubbles can be generated since the outlets have a contraction portion of a small diameter.

Fourthly, generation of air bubbles from the outer side of the air bubble-generating plate can be suppressed since the diameters of the outer outlets are smaller than those of the inner outlets. Accordingly, more air bubbles can be generated from the inner side of the air bubble-generating plate.

Fifthly, more air bubbles flow into the reservoir. Accordingly, washing efficiency is enhanced.

BRIEF DESCRIPTION OF THE DRAWINGS

These and other objects and features of the present invention can be understood through the following embodiment with reference to the accompanying drawings, in which.

DETAILED DESCRIPTION OF THE PREFERRED EMBODIMENTS

Figure 1:
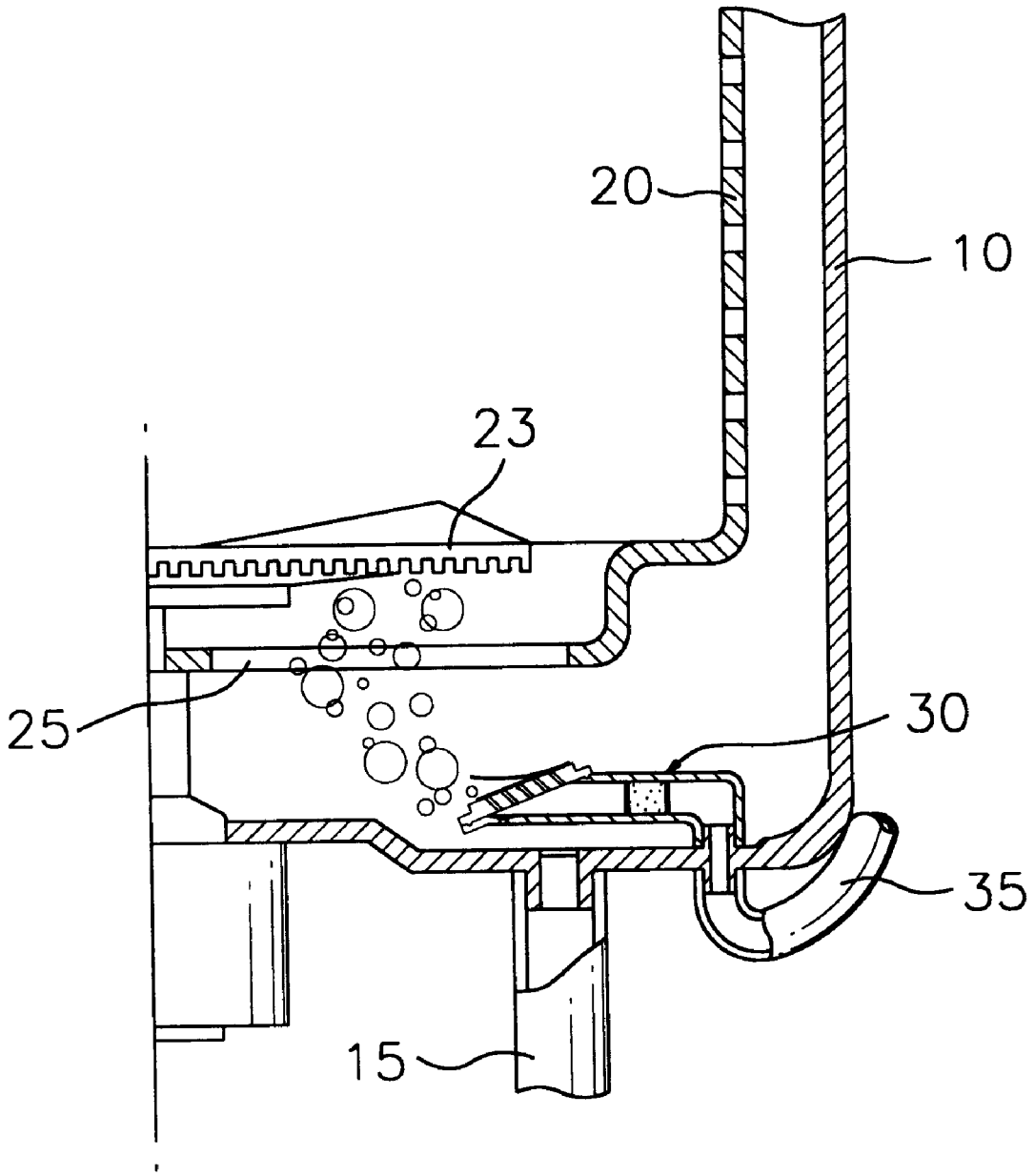
FIG. 1 PRIOR ART
FIG. 1 is a partly cross-sectioned view of an air bubble generator for a conventional washing machine, especially showing arrangement of a rotary tube, a drain pipe, and the air bubble generator.
Figure 2:
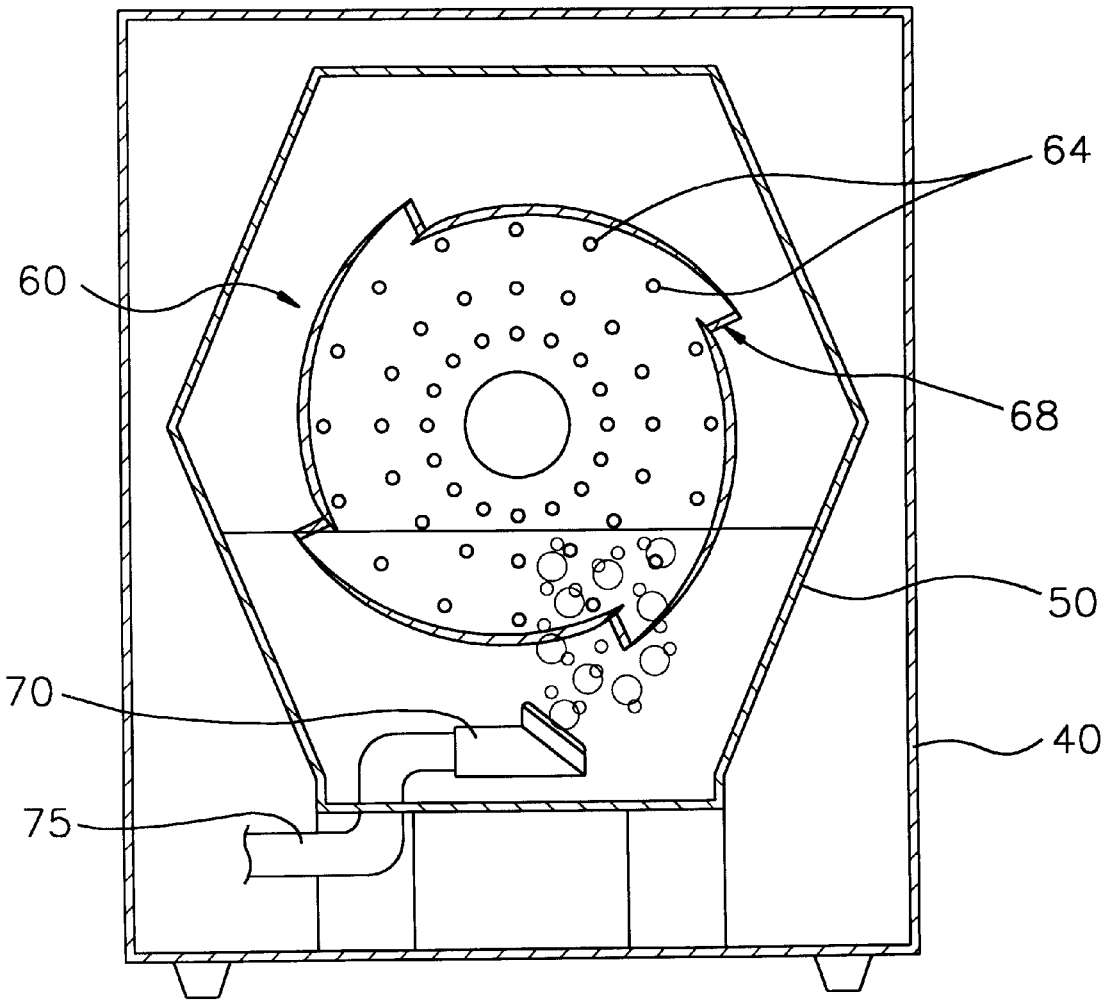
FIG.2 PRIOR ART
FIG. 2 is an arrangement view of a rotary drum and an air bubble generator in a conventional washing machine.
Figure 3:
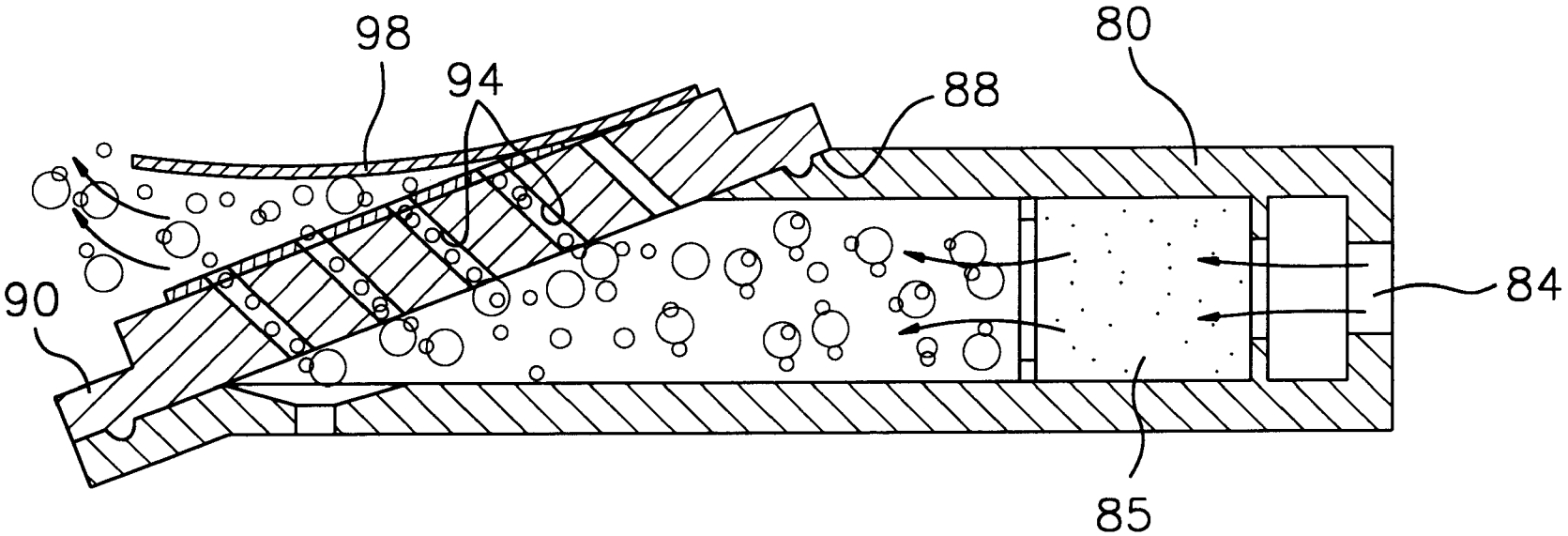
FIG. 3 PRIOR ART
FIG. 3 is an enlarged cross-sectioned view of a conventional air bubble generator.
Figure 4:
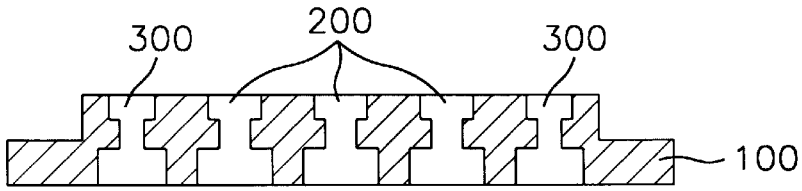
FIG. 4 is a vertically cross-sectioned view of an air bubble-generating plate for an air bubble generator according to an embodiment of the present invention.
Figure 5:
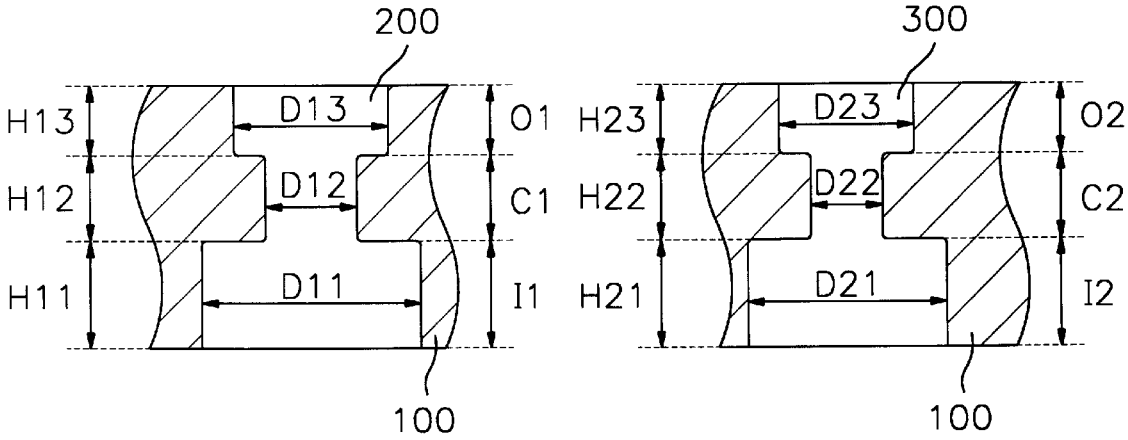
FIG. 5 is a vertically enlarged cross-sectioned view of outlets of the air bubble-generating plate of FIG. 4.
Figure 6:
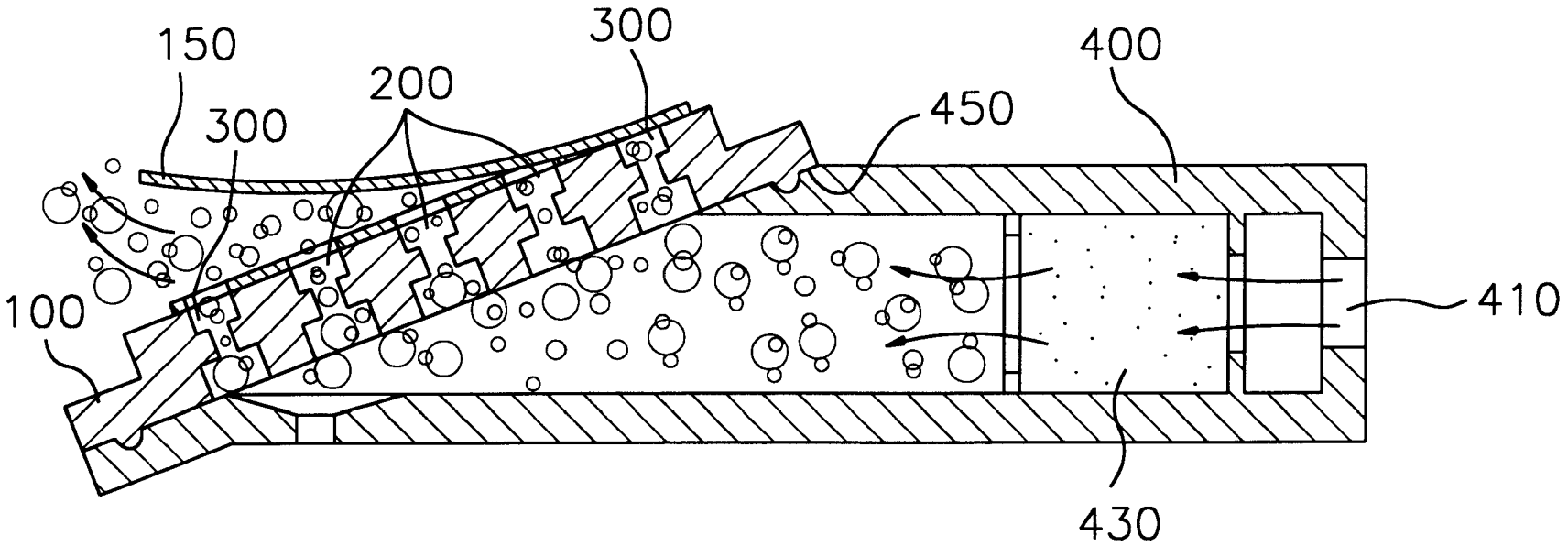
FIG. 6 is a vertically cross-sectioned view of an air bubble-generating plate for an air bubble generator according to another embodiment of the present invention.

A washing machine equipped with an air bubble generator according to an embodiment of the present invention will be described hereinafter with reference to FIGS. 4–6.

An air bubble generator according to an embodiment of the present invention includes an inlet 410 and a case 400. The inlet 410 is connected to an air pump (not shown), and the case 400 has slanted water flowing-out portions 450 opposite to the inlet 410. A porous member 430 is mounted in the case 400. The porous member 430 plays a role of a border wall between the air and washing water. The air from the air pump is converted into fine air bubbles by the porous member 430. An air bubble-generating plate 100 has outlets 200 and 300 and is closely contacted with the slanted water flowing-out portions 450. An elastic plate 150 is further provided, one end of which is fixed on an upper end of the plate 100, so that air bubbles from the plate 100 are restrained from moving further up. As the air bubble generator is operated, the other end of the elastic plate 150, which is movable, is opened by air bubbles flowing out of the outlets 200 and 300.

In order to obtain the objects of the present invention, the diameters of the outlets 200 and 300 are formed to be small enough for obtaining fine air bubbles which flow into the washing water in the reservoir at an early stage. Even though small diameters of the outlets 200 and 300 are theoretically preferable, much smaller diameters compared to a length of movements of air bubbles, that is, a length from the porous member 430 to the air bubble-generating plate 100, prevent air from flowing out of the outlets 200 and 300, since air membranes are formed in the outlets 200 and 300. Further, as air bubbles flow out of the outlets 200 and 300, the air bubble flow-out rate has an influence on the sizes of air bubbles. Since the air bubble flow-out rate is reversely proportional to a cross-sectioned area of the outlets 200 and 300, the air bubble flow-out rate may be controlled by varying a ratio of an air bubble flow-in area and an air bubble flow-out area. Accordingly, the diameter of an outlet 200 or 300 is basically smaller that that of an air bubble which are intended to be generated, and small dynamic resistance and flow-out pressure with respect to the air bubble are preferable. In order to reduce the dynamic resistance and flow-out pressure, each of the outlets 200 and 300 is preferably formed in a way of contraction and enlargement in its diameter, that is, in a type of a contraction/enlargement exhaust nozzle. In a low-moving fluid stream, as the diameter of an outlet is excessively enlarged, an air bubble may become large since the fluid stream is expanded or because of subsequent water stream. Accordingly, a precaution should be taken when enlarging the outlet 200 or 300. In view of the above, an outlet of a contraction/enlargement exhaust nozzle type is required. However, such type of nozzle may be hardly obtained, so that an outlet is formed with different diameters therein substantially as in a contraction/enlargement exhaust nozzle.

The air bubble-generating plate 100 includes inner outlets 200 and outer outlets 300. Each of the inner outlets 200 has a first flow-in portion I1, a first contraction portion C1, and a first flow-out portion O1. The first flow-in portion I1 is formed in a cylindrical shape of a diameter D11 and a height H11. The first contraction portion C1 is communicated with the first flow-in portion I1. Therefore, the diameter of the first flow-in portion I1 is contracted to a diameter of the first contraction portion C1 at the time of their communication. The first contraction portion C1 is formed in a cylindrical shape of a diameter D12 and a height H12. The first flow-out portion O1 is formed in a cylindrical shape of a diameter D13 and a height H13. The first contraction portion C1 is communicated with the first flow-out portion O1. Therefore, the diameter of each of the outlets 200 is enlarged as the first contraction portion C1 is communicated with the first flow-out portion O1. The height H12 of the first contraction portion C1 is larger than that of the first flow-out portion O1, but smaller than that of the first flow-in portion I1. The diameter D13 of the first flow-out portion O1 is larger than that of the diameter D12 of the first contraction portion C1, but smaller than that of the diameter D11 of the first flow-in portion I1.

Each of the outer outlets 200 has a second flow-in portion I2, a second contraction portion C2, and a second flow-out portion 02. The second flow-in portion I2 is formed in a cylindrical shape of a diameter D21 and a height H21. The second contraction portion C2 is communicated with the second flow-in portion I2. Therefore, the diameter of the second flow-in portion I2 is contracted to a diameter of the second contraction portion C2 at the time of their communication. The second contraction portion C2 is formed in a cylindrical shape of a diameter D22 and a height H22. The second flow-out portion O2 is formed in a cylindrical shape of a diameter D23 and a height H23. The second contraction portion C2 is communicated with the second flow-out portion O2. Therefore, the diameter of each of the outlets 300 is enlarged as the second contraction portion C2 is communicated with the second flow-out portion O2. The height H22 of the second contraction portion C2 is larger than that of the second flow-out portion O2, but smaller than that of the second flow-in portion I2. The diameter D23 of the second flow-out portion O2 is larger than that of the diameter D22 of the second contraction portion C2, but smaller than that of the diameter D21 of the second flow-in portion I2.

Comparing the inner outlets 200 and the outer outlets 300, the height of the first flow-in portion I1 is the same as that of the second flow-in portion I2. The diameter D11 of the first flow-in portion I1 is larger than the diameter D21 of the second flow-in portion I2. The height of the first contraction portion C1 is the same as that of the second contraction portion C2. The diameter D12 of the first contraction portion C1 is larger than the diameter D22 of the second contraction portion C2. The height of the first flow-out portion O1 is the same as the height of the second flow-out portion O2. The diameter D13 of the first flow-out portion O1 is larger than the diameter D23 of the second flow-out portion O2.

For a concrete embodiment, it is assumed that desirable diameters of air bubbles range from 1 mm to 2 mm and the height of the air bubble generator is 1.5 mm. At this time, required diameters of the outlets range from 0.6 mm to 0.8 mm. According to the above condition, the first and second flow-in portions I1 and I2 have the same height of 0.7 mm. The diameter D11 of the first flow-in portion I1 is 1.6 mm. The diameter D21 of the second flow-in portion I2 is 1.4 mm. The first and second contraction portions C1 and C2 have the same height of 0.5 mm. The diameter D12 of the first contraction portion C1 is 0.8 mm. The diameter D22 of the second contraction portion C2 is 0.6 mm. The first and second flow-out portions O1 and O2 have the same height of 0.3 mm. The diameter D13 of the first flow-out portion O1 is 1.2 mm. The diameter D23 of the second flow-out portion O2 is 1 mm.

The following effects may be obtained by a washing machine equipped with an air bubble generator according to the embodiment of the present invention.

Firstly, dynamic resistance and flow-out pressure with respect to air bubbles become low since outlets are formed in a contraction/enlargement exhaust nozzle type.

Secondly, a water membrane in an outlet is prevented so that air bubbles flow out of the outlet well since the height of the contraction portion of a small diameter is very small compared to the width of the air bubble generator.

Thirdly, fine air bubbles can be generated since the outlets have a contraction portion of a small diameter.

Fourthly, generation of air bubbles from the outer side of the air bubble-generating plate can be suppressed since the diameters of the outer outlets is smaller than those of the inner outlets. Accordingly, more air bubbles can be generated from the inner side of the air bubble-generating plate.

Fifthly, more air bubbles flow into the reservoir. Accordingly, washing efficiency is enhanced.

It is understood that various other modifications will be apparent to and can be readily made by those skilled in the art without departing from the scope and spirit of this invention. Accordingly, it is not intended that the scope of the claims appended thereto be limited to the descriptions set forth herein, but rather that the claims be constructed as encompassing all the features of the patentable novelty that reside in the present invention, including all the features that would be treated as equivalent thereof by those skilled in the art to which this pertains.

What is claimed is:

1. A washing machine equipped with an air bubble generator for generating air bubbles from compressed air and for dispersing the generated air bubbles into washing water in a washer tub, the air bubble generator comprising an air bubble-generating plate in which outlets of a contraction/enlargement exhaust nozzle type are formed, wherein the outlets are constituted with outer outlets and inner outlets, the outer outlets being formed along edge portions of the air bubble-generating plate, the inner outlets being formed in the inner portions of the air bubble-generating plate, a diameter of each of the outer outlets being smaller than a diameter of each of the inner outlets.

2. A washing machine equipped with an air bubble generator for generating air bubbles from compressed air and for dispersing the generated air bubbles into washing water in a washer tub, the air bubble generator comprising an air bubble-generating Plate in which outlets of a contraction/enlargement exhaust nozzle type are formed, wherein each of the outlets has a cylindrical shape and includes a flow-in portion for receiving the compressed air, a contraction portion communicating with the flow-in portion and for contracting the received air, and a flow-out portion communicating with the contraction portion and for enlarging the contracted air, the flow-in portion, the contraction portion, and the flow-out portion being aligned in a coaxial line.

3. The washing machine as claimed in claim 2, wherein a diameter of the flow-out portion is smaller than a diameter of the flow-in portion, but larger than a diameter of the contraction portion.

4. The washing machine as claimed in claim 2, wherein a height of the contraction portion is larger than a height of the flow-out portion, but smaller than a height of the flow-in portion.

* * * * *